US007674527B2

(12) United States Patent
Yokochi

(10) Patent No.: US 7,674,527 B2
(45) Date of Patent: Mar. 9, 2010

(54) COATED PAPER

(75) Inventor: Eiichiro Yokochi, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 492 days.

(21) Appl. No.: 10/571,431

(22) PCT Filed: Sep. 21, 2004

(86) PCT No.: PCT/JP2004/013765

§ 371 (c)(1),
(2), (4) Date: Sep. 15, 2006

(87) PCT Pub. No.: WO2006/022035

PCT Pub. Date: Mar. 2, 2006

(65) Prior Publication Data

US 2007/0054145 A1 Mar. 8, 2007

(30) Foreign Application Priority Data

Sep. 19, 2003 (JP) ..... 2003-327745

(51) Int. Cl.
*B32B 9/06* (2006.01)

(52) U.S. Cl. ..... 428/411.1; 428/423.1; 428/424.2

(58) Field of Classification Search ..... 428/411.1, 428/423.1, 424.2
See application file for complete search history.

(56) References Cited

U.S. PATENT DOCUMENTS 5,075,153 A * 12/1991 Malhotra ..... 428/207

FOREIGN PATENT DOCUMENTS

JP 49-31033 8/1974
JP 08-118554 5/1996
JP 08-325991 12/1996
JP 09-078485 3/1997
JP 09-235460 9/1997
JP 09-263038 10/1997

(Continued)

OTHER PUBLICATIONS

Tian Rudi, et al; "The Application of Kaolin Clay in the Coatings Industry" Nonmetallic Minerals 1992, No. 5.

*Primary Examiner*—Thao T. Tran
(74) *Attorney, Agent, or Firm*—Ladas & Parry LLP

(57) ABSTRACT

A coated paper having the oil resistance and the marring resistance which cannot be obtained by the addition of the silica particles is provided. The coated paper 10 has a configuration with at least a surface protection layer 2 of a cross-linking cured material of an ionizing radiation curing resin laminated on a fiber substrate 1, wherein the ionizing radiation curing resin of the surface protection layer contains an ethylene oxide modified polymerizable compound, and preferably, the surface protection layer contains baked kaolin particle. By increasing the hydrophilic property with the ethylene oxide modified polymerizable compound, the oil resistance is provided for the surface protection layer itself, and with the baked kaolin particle, the marring resistance can be provided. Moreover, it is preferable to laminate successively a solid colored layer 3A and a primer layer 4 before laminating the surface protection layer on the fiber substrate in terms of the adhesion property and the design property. Moreover, it is preferable to form these layers as a cured material of an urethane resin resulting from a reaction of an acrylic polyol and an isocyanate in terms of the adhesion property and the oil resistance.

5 Claims, 1 Drawing Sheet

FOREIGN PATENT DOCUMENTS

| | | |
|---|---|---|
| JP | 2000-198909 | 7/2000 |
| JP | 2000-211092 | 8/2000 |
| JP | 2001-001453 | 1/2001 |
| JP | 2001-295194 | 10/2001 |
| JP | 2003-340975 | 12/2003 |
| JP | 2004-010855 | 1/2004 |
| WO | WO 00/03874 | 1/2000 |
| WO | WO 03031195 A1 * | 4/2003 |
| WO | WO 2006/022035 | 3/2006 |

* cited by examiner

COATED PAPER

TECHNICAL FILED

The present invention relates to a coated paper to be used for the surface material of various kinds of articles such as a kitchen shelf board and a cupboard. In particular, it relates to a coated paper having the marring resistance and the oil resistance in addition to the surface strength such as the wear resistance.

BACKGROUND ART

Conventionally, a coated paper with the surface strength such as the wear resistance and the abrasion-resistance improved by coating and forming a surface protection layer of a cross-linking cured material of a two component type curing urethane resin, an ionizing radiation curing resin, or the like on the surface of a printing paper with a fiber substrate such as a paper printed and decorated is known (see Japanese Patent Application Publication (JP-B) No. 49-31033).

As the resin for the surface protection layer, a two component curing type urethane resin is well known. Instead of such a thermosetting resin, by using an ionizing radiation curing resin to be cured with an ionizing radiation such as a ultraviolet ray and an electron beam, the following various advantages can be obtained; it is good for the environment since it can be coated and formed in the absence of a solvent without using an organic solvent, and the surface strength such as the wear resistance can be easily achieved since it can provide a high cross link density.

Moreover, in the case the oil resistance is needed for the surface physical properties, a configuration with a thin paper to be used as the fiber substrate impregnated with a resin has been proposed (see Japanese Patent Application Laid-Open (JP-A) No. 8-118554).

DISCLOSURE OF THE INVENTION

Problem to be Solved by the Invention

However, even when the surface protection layer is provided as a cross-linking cured material of an ionizing radiation curing resin as in JP-B No. 49-31033, the surface physical properties can be insufficient. First, one of them is the case when it is used for a shelf board of a kitchen shelf, or the like, and an edible oil adhered on its surface permeates to the inside. The transparency in the permeated portion increases to provide an external appearance as being wet with water, and remains as it is as the so-called wet color.

Providing the surface protection layer thickly by about several tens of μm, of course, since the surface protection layer can be formed as a dense layer, prevents the oil from penetrating to below the surface protection layer so that the wet color cannot be caused. However, in this case, using a coated paper provided with a surface protection layer of an ionizing radiation curing resin which tends to be harder than a thermosetting resin, lowers its flexibility. Consequently, the work suitability at the time of laminating onto various kinds of substrates as a roll paper, or the like is lowered. Moreover, also in terms of the material cost, the cost is increased. Therefore, from the viewpoints of the work suitability, the cost, and others, the thickness of the surface protection layer in general is 10 μm or less, and it is made as thin as possible to the extent that the performance allows. However, with the thickness made thinner, influence of the permeation of the coating solution to the fiber substrates becomes more significant at the time of forming the surface protection layer. As a result, the density is lowered so as to increase the gaps in the surface protection layer. In consequence, due to the gaps, the oil adhered on the coated paper surface permeates into the inside so as to provide the wet color.

Preliminarily impregnating the fiber substrate itself with a resin as disclosed in JP-A No. 8-118554 stops the permeation to the inside of the surface protection layer before the fiber substrate, even when the oil resistance of layer itself is slightly poor. Nonetheless, the problem of the poor oil resistance of the surface protection layer itself cannot be solved. Additionally, a resin-impregnated product causing a cost rise is needed as the fiber substrate, and the work suitability is lowered due to the flexibility decline.

Moreover, the other surface physical property to be insufficient other than the oil resistance is the marring resistance. Therefore, it is preferable that a coated paper of the present invention has the marring resistance. Even in the case the surface strength, such as the wear resistance is obtained sufficiently by using a cross-linking cured material of an ionizing radiation curing resin for the surface protection layer, the marring resistance is another flaw resistance performance. In the case of the wear resistance, in general, it is dealt with by adding silica particles, or the like in the surface protection layer as a filling so as to cure the surface protection layer. However, particularly in the case of the surface gloss being adjusted by the surface protection layer as the design expression, the gloss may be enhanced by an assembly of extremely faint abrasions. For example, it occurs in the case of laminating and transporting a large number of decorative sheets produced by attaching a coated paper onto a substrate of a woody plate, or the like so that the decorative sheets (coated paper) surface is rubbed by the vibration, handling the sheets in the decorative sheet production line, or the like. If the portion to have the faint abrasions expands evenly on the entire surface, it is not so serious. If apart of the surface is rubbed frequently, however, the surface gloss becomes conspicuous as spots so as to be the production defect. In particular, the production defect after being attached onto the substrate becomes the defect which includes the substrate also in addition to the coated paper. Thus a problem is involved in that the loss in terms of the cost is significant compared with the case of the coated paper alone. Therefore, the marring resistance of hardly generating the gloss change even when the surface is rubbed is required.

That is, an object of the present invention is to provide a coated paper having the marring resistance, capable of improving the oil resistance of not changing the external appearance even in the case of being soiled with oil, and preferably capable of also improving the marring resistance.

Means for Solving the Problem

In order to solve the above-mentioned problem, a coated paper of the present invention has a configuration comprising at least a surface protection layer of a cross-linking cured material of an ionizing radiation curing resin laminated on a fiber substrate, wherein the ionizing radiation curing resin of the surface protection layer contains an ethylene oxide modified polymerizable compound.

Such configuration reduces the affinity of the resin of the surface protection layer with respect to the oil. Consequently, the oil permeation into the coated paper through the surface protection layer is restrained so that the oil resistance can be improved.

Moreover, according to a preferable embodiment of the above-mentioned coated paper of the present invention, the surface protection layer contains a baked kaolin particle in the above-mentioned configuration.

According to the configuration, since the baked kaolin particle is contained in the surface protection layer as a filling, the marring resistance can be improved.

Moreover, according to a preferable embodiment of the above-mentioned coated paper of the present invention, in the above-mentioned configuration, the surface protection layer is laminated after successively laminating a solid colored layer and a primer layer on the fiber substrate. Such configuration improves the design property by the solid colored layer, and the adhesion property of the surface protection layer by the primer layer. As a result, further excellence can be provided.

Moreover, according to a preferable embodiment of the above-mentioned coated paper of the present invention, in the above-mentioned configuration, the solid colored layer and the primer layer are a cured material of an urethane resin resulting from a reaction of an acrylic polyol and an isocyanate. Such configuration can further improve the adhesion property and the oil resistance of the surface protection layer.

Effect of the Invention (1) According to a coated paper of the present invention, the oil resistance with respect to an oil adhered on the coated paper surface can be improved. Therefore, in the case it is used for a shelf board for a kitchen shelf, or the like, the so-called wet color caused by an edible oil adhered on the surface permeating to the inside and increasing the transparency in the permeated portion to provide and to remain the external appearance of being wet with water can be prevented. Furthermore, in the case of the configuration with the surface protection layer containing the baked kaolin particle, the marring resistance can also be preferable.

(2) Moreover, by providing the solid colored layer and the primer layer between the fiber substrate and the surface protection layer, the design property is improved so that the adhesion property of the surface protection layer can be improved.

(3) Moreover, at the time, by providing the solid colored layer and the primer layer as a cured material of an urethane resin resulting from a reaction of an acrylic polyol and an isocyanate, the adhesion property and the oil resistance of the surface protection layer can further be improved.

BEST MODE FOR CARRYING OUT THE INVENTION

Hereinafter, embodiments of the present invention will be explained with reference to the drawings.

Summary:

First, FIGS. 1A to 1C are cross-sectional views for explaining a coated paper 10 of the present invention. FIG. 1A is the case of a configuration showing a most basic layer configuration comprising two layers of a fiber substrate 1 and a surface protection layer 2. The coated paper 10 of FIG. 1B has a configuration comprising a solid colored layer 3A provided on the fiber substrate 1 so as to be disposed between the fiber substrate 1 and the surface protection layer 2 as the decoration process, and a primer layer 4 provided further thereon. Moreover, the coated paper 10 of FIG. 1C has a configuration, wherein configuration of FIG. 1B is further treated with a decoration process of providing a configuration comprising a graphic pattern layer 3B as a decorative layer 3 between the solid colored layer 3A and the surface protection layer 2 (in the figure, strictly speaking, between the layer 3A and the primer layer 4) so as to provide the decorative layer 3 constituted with both of the solid colored layer 3A and the graphic pattern layer 3B. Then, therein, the surface protection layer 2 comprises a cross-linking cured material of an ionizing radiation curing resin, and a resin containing an ethylene oxide modified polymerizable compound is used as the ionizing radiation curing resin. Furthermore, baked kaolin particle is preferably added as a filling in the surface protection layer using the resin. Since a resin containing an ethylene oxide modified polymerizable compound is used as the ionizing radiation curing resin, the affinity with respect to an oil of the surface protection layer itself is lowered. As a result, the oil resistance can be improved. Furthermore, by preferably using the baked kaolin particle as a filling in the surface protection layer instead of merely an ordinary kaolin particle, the marring resistance can be improved.

The coated paper of the present invention may have a two-layer configuration of only the fiber substrate 1 and the surface resistance layer 2 as shown in FIG. 1A. In general, for providing a better design as a coated paper, a configuration with any decoration process applied as shown in, for example, FIG. 1B is used. The decoration process is applied in general to the fiber substrate.

Hereinafter, the coated paper of the present invention will be described in detail for each layer.

Fiber Substrate:

The fiber substrate 1 is a substrate made of fibers. A paper is representative thereof, and additionally, a non woven fabric, a laminated member thereof, or the like may be used as well. As the paper, for example, a thin paper, a craft paper, a high-quality paper, a linter paper, a baryta paper, a parchment paper, a Japanese paper, or the like can be used. Moreover, as the non woven fabric, for example, a non woven fabric made of fibers of a polyester resin, an acrylic resin, a nylon, a vinylon, a glass, or the like can be used. The grammage of the paper or the non woven fabric is in general about 20 to 100 $g/m^2$.

For reinforcing the interlayer strength between the fibers or with respect to the other layers, or preventing fuzz, a resin such as an acrylic resin, a styrene butadiene rubber, a melamine resin, and an urethane resin may be added further to the paper or the non woven fabric (resin impregnation after the papermaking, or filling at the time of the papermaking). However, compared to those with the resin impregnation, those without the resin impregnation facilitate better improvement effects of the oil resistance performance of the present invention, and furthermore, they are advantageous in terms of the cost.

Surface Protection Layer:

The surface protection layer 2 is provided as the uppermost layer of the coated paper. It is formed as a cross-linking cured material using an ionizing radiation curing resin as its resin and by cross linking and curing the resin. The surface protection layer is a layer for providing the chemical surface physical properties (pollution resistance, chemical resistance, cellophane tape resistance, or the like), and mechanical physical properties (scratch resistance, wear resistance, or the like) according to the application for the purpose equivalent to the original purpose thereof, that is, the purpose similar to that of the conventional surface protection layer. In the present invention, the oil resistance is improved by using a resin containing an ethylene oxide modified polymerizable compound in the ionizing radiation curing resin of the surface protection layer. Furthermore, preferably, by containing the baked kaolin particle in the surface protection layer, the marring resistance is improved.

That is, as to the oil resistance, by employing the ionizing radiation curing resin containing the ethylene oxide modified polymerizable compound for the surface protection layer, compared with the case otherwise, the affinity with respect to the oil of the surface protection layer can be lowered since the ethylene oxide portion of the compound is hydrophilic. As a result, permeation of the oil such as the edible oil and the margarine adhered on the surface protection layer into the surface protection layer can be restrained so that a coated paper with the oil resistance improved by the surface protection layer itself can be provided.

The above-mentioned ethylene oxide modified polymerizable compound is a compound to have the polymerization reaction by an ionizing radiation, and is a compound having an ethylene oxide modified portion. As such an ethylene oxide modified polymerizable compound, one matching the application can optionally be used. As the specific examples of the ethylene oxide modified polymerizable compound, for example, a trimethylol propane ethylene oxide modified tri (meth)acrylate, a bisphenol A ethylene oxide modified di(meth)acrylate, or the like can be presented. The expression in this specification "(meth)acrylate" denotes an acrylate or a methacrylate. Moreover, as the general term for the acrylate compound and the methacrylate compound, they can be referred to also as simply the acrylate (compound).

Moreover, as the number of linkage n (number per one molecule) of the ethylene oxide repeating unit in the ethylene oxide modified portion increases, the oil resistance increases. On the contrary, due to the increase of the hydrophilic property, the water resistance, and the pollution resistance with respect to the water based pollutant such as the water based ink are lowered. Therefore, the n number can be adjusted optionally. For example, n is 2 to 20, preferably it is 4 to 15.

The ethylene oxide modified polymerizable compound may be a compound of bifunctional, trifunctional or another multifunctional. For example, tetrafunctional or more can be cited. These may be decided optionally in consideration to the film hardness required as the surface protection layer, or the like.

As the ionizing radiation curing resin used for the surface protection layer, the entire amount of the resin component to be reacted by polymerization by the ionizing radiation may be an ethylene oxide modified polymerizable compound. Another polymerizable compound to be reacted by polymerization by the ionizing radiation may optionally be used in combination depending on the other physical properties other than the oil resistance, such as the pollution resistance with respect to the water based ink, or the like of the surface. Specifically, with only the ethylene oxide modified polymerizable compound alone, although the oil resistance improves owing to the increase of the hydrophilic property of the surface protection layer, the pollution resistance with respect to the water based pollutant such as a water based ink can be lowered due to the increase of the affinity with respect to a water based substance. In such a case, a polymerizable compound, which is not hydrophilic, such as an ethylene oxide non modified acrylate monomer and/or pre polymer (an ordinary acrylate monomer and/or pre polymer) may be included. For achieving both the oil resistance and the pollution resistance with respect to the water based pollutant, the composition ratio is preferably in a range of (ethylene oxide modified polymerizable compound)/(ethylene oxide non modified acrylate monomer and/or pre polymer)=3/7 to 5/5 (mass ratio)

Although a propylene oxide is an alkylene oxide compound similar to the ethylene oxide, if a propylene oxide modified compound is used instead of an ethylene oxide modified compound, the increase tendency of the hydrophilic property is small due to the reduction of the relative proportion of an ether bond. Consequently, a preferable oil resistance cannot be obtained.

As an ionizing radiation curing resin to be used other than the ethylene oxide modified compound, a conventionally known compound may be used optionally.

For example, in the monomers, as to a monomer having a radically polymerizable unsaturated group in a molecule, the acrylate based monomers are representative. For example, as the monofunctional monomer, a methyl(meth)acrylate, a 2-ethyl hexyl(meth)acrylate, a phenoxy ethyl(meth)acrylate, or the like can be presented. As the multifunctional monomer, a diethylene glycol di(meth)acrylate, a propylene glycol di(meth)acrylate, a trimethyl propane tri(meth)acrylate, a dipentaerythritol tetra(meth)acrylate, a dipentaerythritol penta(meth)acrylate, a dipentaerythritol hexa(meth)acrylate, or the like can be presented.

Moreover, as the pre polymers, the acrylate based pre polymers are representative. For example, a polyester(meth)acrylate, an urethane(meth)acrylate, an epoxy (meth)acrylate, a melamine(meth)acrylate, a triadine (meth)acrylate, a silicone (meth)acrylate, or the like can be presented. As to the molecular weight of the pre polymers, in general, those having about 250 to 100,000 can be used.

The ethylene oxide modified polymerizable compound, or the other ionizing radiation curing resins are not limited to the above-mentioned compounds, and another compound may be used optionally in consideration to the required physical properties, or the like.

Moreover, as needed, a resin other than the ionizing radiation curing resin, that is, an ionizing radiation non curing resin may be further used in combination. Examples of the ionizing radiation non curing resin are a thermoplastic resin such as a vinyl chloride-vinyl acetate copolymer, a vinyl acetate resin, an acrylic resin and a cellulose resin.

On the other hand, the baked kaolin particle preferably used in the present invention for the purpose of providing the marring resistance is a kaolin particle obtained by baking a general (hydrate) kaolin particle. By adding the baked kaolin particle as a filling, improvement of the marring resistance, which has not been achieved by the silica particles or the hydrate kaolin particle before baking, can be realized. The particle size of the baked kaolin particle can be selected optionally according to the application, the required physical properties, or the like. For example, those having the average particle size of about 0.5 to 2 μm can be used. Moreover, the addition amount of the baked kaolin particle can be selected optionally according to the application, the required physical properties, or the like. For example, it is about 5 to 50 parts by mass with respect to 100 parts by mass of the ionizing radiation curing resin (however, in the case the surface protection layer includes another resin, the total of the ionizing radiation curing resin and the other resin).

The glossiness change of the surface as the subject of the "marring resistance" is in general the rise in the glossiness in the case of having the surface glossiness appropriately lowered in terms of the design for the glossiness adjustment (it can be also referred to as the semi glossiness) so that it is the glossiness change due to the decline in the mat feeling of the surface. However, the glossiness change as the subject of the marring resistance includes also the glossiness decline in addition to the glossiness rise.

Moreover, it is advantageous in terms of the transparency of the surface protection layer that the baked kaolin particle has the refractive index in a range of 1.6 to 1.7, in particular, at 1.65 as the central value thereof (the hydrate kaolin particle has the refractive index of 1.56) so as to get closer to the refractive index of the resin of the surface protection layer. Moreover, the baked kaolin particle is superior to the hydrate kaolin particle also in terms of the coating stability.

Moreover, as the baked kaolin particle, those further with the surface process applied to the surface may be used. By use of the baked kaolin particle with the surface process applied, the marring resistance improving effect can further be enhanced. As the surface process, the surface process with a silane coupling agent can be presented. As the silane coupling agent, the known silane coupling agents having an alkoxy group, an amino group, a vinyl group, an epoxy group, a mercapto group, a chloro group, or the like can be presented. Examples thereof include a γ-amino propyl triethoxy silane, a γ-methacryloxy propyl trimethoxy silane, a γ-methacryloxy propyl methyl dimethoxy silane, a γ-methacryloxy propyl dimethyl methoxy silane, a γ-methacryloxy propyl triethoxy silane, a γ-methacryloxy propyl dimethyl ethoxy silane, a γ-acryloxy propyl trimethoxy silane, a γ-acryloxy propyl methyl dimethoxy silane, a γ-acryloxy propyl dimethyl methoxy silane, a γ-acryloxy propyl triethoxy silane, a γ-acryloxy propyl methyl diethoxy silane, a γ-acryloxy propyl dimethyl ethoxy silane, a vinyl triethoxy silane, a γ-glycidoxy propyl trimethoxy silane, a γ-mercapto propyl trimethoxy silane, or the like.

In the surface protection layer, other known additives, such as a lubricant including a silicone resin and a wax, a dispersing agent such as a fine particle silica, an antifriction composition including a silica particle and an alumina particle, a glossiness adjusting agent such as a silica particle, a coloring agent, a stabilizing agent, and an fungicide may be added optionally as needed.

The ionizing radiation for cross linking and curing the ionizing radiation curing resin denotes an electromagnetic wave or a charge particle having the energy capable of polymerizing and cross linking the molecules. In general, an electron beam (EB) or a ultraviolet ray (UV) is common. Moreover, in the case the ultraviolet ray is used as the ionizing radiation, a photo polymerization initiating agent for example, acetophenones, benzophenones, or the like are added to the ionizing radiation curing resin.

The surface protection layer is formed in general as a transparent layer without coloring. Alternatively it is formed as a colored transparent layer. This is for viewing the decorative layer provided in general below the surface protection layer. If it is not necessary in the case the decorative layer is not provided, or the like, it may be opaque without coloring or colored and opaque.

Moreover, formation of the surface protection layer may be carried out according to a known film forming method such as a coating method gravure coating, roll coating and the like, and a printing method gravure printing, gravure offset printing, screen printing and the like. To the ionizing radiation curing resin (composition), a solvent may be added optionally for adjusting the coating suitability, the printing suitability, or the like.

The thickness of the surface protection layer is in general about 2 to 10 g/m$^2$ (based on the solid content) in terms of the coating amount. Conventionally, for obtaining the oil resistance by the surface protection layer, the thickness of the surface protection layer needs to be a thickness (coating amount) exceeding 10 g/m$^2$, such as 20 g/m$^2$ and 30 g/m$^2$. However, in the present invention, since the resin of the surface protection layer itself has the oil resistance improved, the oil resistance as the coated paper can be obtained with 10 g/m$^2$ or less. Moreover, the flexibility of the coated paper can be obtained so as to have a preferable process suitability, and furthermore, it is advantageous in terms of the cost.

Decorative Layer:

As the coated paper, configuration thereof may be the above-mentioned configuration comprising only two layers of the fiber substrate and the surface protection layer, or a primer layer, or the like of a two component curing type urethane resin, or the like provided therebetween as shown in FIG. 2 for reinforcing the adhesion property of the both layers. In general, a configuration with any decoration process applied is adapted for improving the design property as the coated paper. Even in the case of a coated paper with the fiber substrate and the surface protection layer provided as the main body, the decoration process such as to make the fiber substrate to a colored paper by adding a coloring agent to the substrate, adding a coloring agent into the surface protection layer, or the like can be enabled. However, according to a colored paper, the color freedom degree of each product is low and a high design expression of a printing pattern or the like cannot be achieved. Therefore, in general, a better design is achieved by providing at least a solid colored layer 3A with the entire surface solid pattern expressed as shown in FIG. 1B as the decorative layer or furthermore, a graphic pattern layer 3B with a patterned graphic expressed as shown in FIG. 1C as the decorative layer. The graphic of the graphic pattern layer may be for example, a woodgrain pattern, a graining pattern, a sand pattern, a blanket texture pattern, a tile pattern, a brick pattern, a leather pattern, a character, a mark, a geometric pattern, a combination of two or more kinds thereof, or the like.

The content of the decoration process as mentioned above is not particularly limited, and various kinds of the conventionally known decoration processes in the field of the so-called coated paper can be adopted optionally. Therefore, the decoration process may be the surface concavo-convex form of forming a concavo-convex pattern (concavo-convex shape) on the surface of the surface protection layer, or the like. For example, it is a concavo-convex pattern with the convex portion other than the concave portion provided as a flat surface as in the case of a concavo-convex pattern of a wood conduit groove. In this case, the marring resistance is the resistance with respect to the glossiness change in the flat surface (convex portion) portion microscopically. The concavo-convex pattern may be for example, a wood conduit groove, a joint groove of a tile or a brick, a relief pattern, a character, a diagram, a geometric pattern, a satin finish, a concavo-convex pattern of a cleavage surface of a granite, or the like, or a combination thereof, or the like.

Here, as a representative example of the decoration process, the decorative layer 3 of the solid colored layer 3A or the graphic pattern layer 3B will be explained.

First, it is preferable to provide the decorative layer 3 as a layer inside the coated paper in terms of the durability thereof. Therefore, the decorative layer is provided at a position between the fiber substrate and the surface protection layer, and in general it is provided on the front side surface of the fiber substrate. The solid colored layer and the graphic pattern layer of the decorative layer are used each alone or in a combination. Moreover, in addition to the decoration function, the solid colored layer can also provide the function of blocking property with respect to the base, or the function of improving the oil resistance by preventing permeation of the oil into the fiber substrate by being provided on the fiber substrate concerning the oil resistance.

The forming method, the material, or the like of the decorative layer are not particularly limited, and they can be selected according to the application. That is, the decorative layer may be formed using an ink or a coating solution by the conventionally known printing methods such as gravure printing, silk screen printing, offset printing, gravure offset printing and ink jet printing. Moreover, the solid colored layer may be formed by the conventionally known coating methods, such as gravure coating and roll coating.

The ink (or coating solution) used for forming the decorative layer is made of a vehicle such as a binder or the like, a coloring agent such as a pigment and a dye, and various kinds of additives to be added optionally thereto such as an extender pigment, a stabilizing agent, a plasticizing agent, a catalyst and a curing agent. According to the required physical properties, the printing suitability, or the like, those conventionally known can be selected and used optionally.

For example, as the resin for the binder, a thermoplastic resin, a thermosetting resin, an ionizing radiation curing resin, or the like are used. For instance, a cellulose based resin such as a nitro cellulose, a cellulose acetate and a cellulose acetate propionate, an acrylic resin such as a polymethyl (meth)acrylate, a polybutyl(meth)acrylate and a methyl (meth)acrylate-butyl(meth)acrylate-2 hydroxy ethyl(meth) acrylate copolymer, an urethane resin, a vinyl chloride-vinyl acetate copolymer, a polyester resin, an alkyd resin, or the like alone or a mixture containing thereof can be used. However, among them, an urethane resin is a preferable resin in terms of the good adhesion property. Moreover, as the urethane resin, a two component curing type urethane resin, in particular, a two component curing type urethane resin resulting from a reaction of an acrylic polyol and an isocyanate is preferable. This is because the adhesion property can easily be obtained since the acrylic polyol is a compound similar to the acrylate based ionizing radiation curing resin as the surface protection layer, and because the oil resistance of the resin itself is also preferable.

Moreover, as the coloring agent, an inorganic pigment such as a titanium white, a carbon black, an iron black, a red iron oxide, a chrome yellow d and an ultramarine, an organic pigment such as an aniline black, a quinacrydine red, an isoindolinone yellow and a phthalocyanine blue, a bright pigment such as foils of a titanium oxide covered mica, and an aluminum, or another dye, or the like is used.

Primer Layer:

It is preferable to provide the primer layer 4 between the surface protection layer and the fiber substrate in the case reinforcement of the interlayer adhesion property between the surface protection layer and the fiber substrate is necessary. As the specific example of a position for providing the primer layer, in the case of providing the solid colored layer 3A between the fiber substrate 1 and the surface protection layer 2 as shown in FIG. 1B, it is between the solid colored layer 3A and the surface protection layer 2, or the like. Moreover, in the case a graphic pattern layer is provided, as shown in FIG. 1C, it is between the graphic pattern layer and the surface protection layer, or the like. In particular, since the adhesion of the surface protection layer may be lowered due to the formation with an ionizing radiation curing resin, as shown in the above-mentioned example, it is preferable to provide the same immediately below the surface protection layer.

Moreover, apart from the primer layer improves the scratch resistance, the wear resistance, or the like by its adhesion reinforcing function and stress relaxation function, the layer controls the glossiness of the surface protection layer by being the base of the surface protection layer. Furthermore, as in the case of the above-mentioned colored solid layer, the primer layer provides the function of improving the oil resistance in terms of preventing permeation of the oil into the fiber substrate by being provided on the fiber substrate. Moreover, in terms of the oil resistance improvement, it is preferable to raise the cross linking density.

The resin for the primer layer is basically not particularly limited as long the adhesion property can be improved. For example, a resin such as an urethane resin, an acrylic resin and a polyvinyl butyral can be used by one kind or two or more kinds as a mixture. However, among these, an urethane resin is preferable in terms of the improving easiness of the adhesion property. Moreover, as the urethane resin, a two component curing type urethane resin, in particular, a two component curing type urethane resin resulting from a reaction of an acrylic polyol and an isocyanate is preferable. Since the acrylic polyol is a compound similar to the acrylate based ionizing radiation curing resin as the surface protection layer, the adhesion property can easily be obtained, and furthermore, the oil resistance of the resin itself is also preferable.

As the acrylic polyol, a copolymer having a plurality of hydroxyl groups in a molecule obtained by copolymerization of an alkyl ester(meth)acrylate such as a methyl(meth)acrylate, an ethyl(meth)acrylate, a butyl(meth)acrylate, a 2-ethyl hexyl(meth)acrylate and an octyl(meth)acrylate, an ester (meth)acrylate having a hydroxyl group in a molecule such as a 2-hydroxy ethyl(meth)acrylate, a 2-hydroxy butyl(meth) acrylate and a 2-hydroxy-3-phenoxy propyl(meth)acrylate, and furthermore, as needed, another monomer such as a styrene monomer can be used. As the specific examples of the acrylic polyol, for example, a methyl(meth)acrylate-2 hydroxy ethyl(meth)acrylate copolymer, an octyl(meth)acrylate-ethyl hexyl(meth)acrylate-2 hydroxy ethyl(meth)acrylate copolymer, a methyl(meth)acrylate-butyl(meth)acryalte-2 hydroxy ethyl(meth)acrylate-styrene copolymer, or the like can be presented.

Moreover, as the isocyanate, the conventionally known compounds can be used optionally. For example, a polyisocyanate such as an aromatic isocyanate including a 2,4-trilene diisocyanate, a xylene diisocyanate, a naphthalene diisocyanate and a 4,4'-diphenyl methane diisocyanate, and an aliphatic (or alicyclic) isocyanate such as a 1,6-hexamethylene diisocyanate, an isophorone diisocyanate, a hydrogenated trilene diisocyanate and a hydrogenated diphenyl methane diisocyanate, or the like can be used. Alternatively an adduct or a polymer of the various kinds of the isocyanates, such as an adduct of a trilene diisocyanate, a trilene diisocyanate trimer, or the like can also be used.

The primer layer may be formed with a coating solution (or an ink) made of these resin by a known coating method such as gravure coating and roll coating, or a known printing method such as gravure printing. The coating amount of the primer layer is in general about 0.5 to 5 g/m$^2$ (based on the solid content).

Substrate to be Adhered:

The coated paper of the present invention can be used as a decorative material such as a decorative sheet by being attached onto the surface of various substrates to be adhered, and the substrate to be adhered is not particularly limited. A representative example of the substrate to be adhered is a woody plate material. Furthermore, as the examples of the substrate to be adhered, as to the materials, in addition to the woody, the resin based, the inorganic non metal based, the metal based, the composite thereof based, or the like can be presented. Moreover, as to the shape, a flat plate is representative, and additionally, there are a curve plate, a polygonal column, or the like. As a further specific example of the woody plate material, there are a single plate, a plywood, a particle board, a fiber board (MDF: medium-density fiberboard, or the like), a laminated wood, or the like, made of Japanese cedar, Japanese cypress, oak, lauan, teak, or the like.

Applications:

The applications of the coated paper of the present invention are not particularly limited, and it can be used preferably for the applications requiring the oil resistance. Furthermore, in the case of a configuration with the surface protection layer containing the baked kaolin particle, it can be used preferably also for the applications requiring the marring resistance. For example, as those attached onto the surface of the substrate to be adhered as mentioned above, it can be used for various kitchen instrument members, and example thereof are the surface material for the furniture and the fittings such as a door for the kitchen furniture, a kitchen shelf board a cupboard and a table top, or the like. The marring resistance as mentioned above has the function as the required physical properties at the time of transporting the product or the member in addition to the applications for the final product.

Hereinafter, the present invention will be described further in detail with reference to the examples and the comparative examples.

EXAMPLE 1

A coated paper 10 as shown in the cross-sectional view of FIG. 2 was produced as follows. After forming a primer layer 4 of a two component curing type urethane resin resulting from a reaction of an acrylic polyol and an isocyanate on a fiber substrate 1 made of a general paper for the building materials of a 30 g/m2 grammage by a 3 g/m$^2$ thickness with gravure printing, an electron beam curing type resin coating solution of the below-mentioned composition, including a trimethylol propane EO (ethylene oxide) modified triacrylate (number of linkage of the ethylene oxide n=9) of an acrylate based trifunctional monomer as the ethylene oxide modified polymerizable compound was formed further thereon by a 4 g/m$^2$ thickness (based on the solid content) with a gravure offset method. Thereafter, by cross linking and curing the coating film by directing an electron beam, and then, curing and cross linking the primer layer, a coated paper 10 having a non colored transparent surface protection layer 2 was obtained. The evaluation results are shown in Table 1 together with the other examples and comparative examples.

Composition of the Electron Beam Curing Type Resin Coating Solution:

| | |
|---|---|
| Trimethylol propane EO modified triacrylate (n = 9) | 40 parts by mass |
| Pentaerythritol tetraacrylate | 60 parts by mass |

EXAMPLE 2

A coated paper was produced in the same manner as in the example 1 except that a trimethylol propane EO modified triacrylate having a 4 n number (n=4) was used instead of the trimethylol propane EO modified triacrylate (n=9) in the electron beam curing type resin coating solution used for the formation of the surface protection layer in the example 1.

COMPARATIVE EXAMPLE 1

A coated paper was produced in the same manner as in the example 1 except that a trimethylol propane EO modified triacrylate having a 2 n number (n=2) was used instead of the trimethylol propane EO modified triacrylate (n=9) in the electron beam curing type resin coating solution used for the formation of the surface protection layer in the example 1.

COMPARATIVE EXAMPLE 2

A coated paper was produced in the same manner as in the example 1 except that a trimethylol propane EO modified triacrylate having a 29 n number (n=23) was used instead of the trimethylol propane EO modified triacrylate (n=9) in the electron beam curing type resin coating solution used for the formation of the surface protection layer in the example 1.

COMPARATIVE EXAMPLE 3

A coated paper was produced in the same manner as in the example 1 except that a propylene oxide modified monomer (trimethylol propane propylene oxide modified triacryalte) was used instead of the trimethylol propane EO modified triacrylate in the electron beam curing type resin coating solution used for the formation of the surface protection layer in the example 1.

COMPARATIVE EXAMPLES 4 to 9

A coated paper was produced in each of the comparative examples in the same manner as in the example 1 except that the polymerizable compounds mentioned in Table 1 was used for each comparative examples instead of the trimethylol propane EO modified triacrylate in the electron beam curing type resin coating solution used for the formation of the surface protection layer in the example 1.

EXAMPLES 3 and 4

A coated paper was produced in each examples in the same manner as in the example 1 except the composition ratio (mass ratio) of the ethylene oxide modified monomer made of the trimethylol propane EO modified triacrylate and the tetrafunctional acrylate monomer for each examples was changed as mentioned in Table 2 in the electron beam curing type resin coating solution used for the formation of the surface protection layer in the example 1.

COMPARATIVE EXAMPLES 10 to 13

A coated paper was produced in each comparative examples in the same manner as in the example 1 except the composition ratio (mass ratio) of the ethylene oxide modified monomer made of the trimethylol propane EO modified triacrylate and the tetrafunctional acrylate monomer for each comparative examples was changed as mentioned in Table 2 in the electron beam curing type resin coating solution used for the formation of the surface protection layer in the example 1.

EXAMPLE 5

A coated paper 10 as shown in FIG. 1B was produced in the same manner as in the example 1 except that a colored solid layer 3A with a titanium oxide added to a two component curing type urethane resin resulting from a reaction of an acrylic polyol and an isocyanate as the coloring agent was formed by gravure printing prior to the formation of the primer layer in the example 1. The evaluation results are shown in Table 3.

Performance Evaluation

The coated papers produced each of the examples and comparative examples were evaluated in terms of the oil resistance and the pollution resistance.

As to the oil resistance, after dropping a cooking oil onto the coated paper surface and leaving for 24 hours, the wet color by the cooking oil permeation was observed visually and evaluated. Those without the permeation were judged to be preferable (○), those with the permeation observed slightly were judged to be slightly preferable (Δ), and those with the permeation apparently observed were judged to be poor (×).

As to the pollution resistance, whether the pollution resistance with respect to the water based pollutants was lowered on the contrary to their preferable oil resistance was confirmed for those with the preferable oil resistance. Specifically, after dropping a water based blue ink onto the coated paper surface and leaving for 24 hours, it was wiped off with a gauze soaked with an alcohol to visually observe the pollution by the water based blue ink and to evaluate. Those without the pollution were judged to be preferable (○), those with the pollution observed slightly were judged to be slightly preferable (Δ), and those with the pollution apparently observed were judged to be poor (×).

TABLE 1

Performance evaluation results

| | Polymerizable compound | Oil resistance | Pollution resistance |
|---|---|---|---|
| Example 1 | Ethylene oxide modified monomer (n = 9) | ○ | ○ |
| Example 2 | Ethylene oxide modified monomer (n = 4) | ○ | ○ |
| Comparative Example 1 | Ethylene oxide modified monomer (n = 2) | Δ | ○ |
| Comparative Example 2 | Ethylene oxide modified monomer (n = 23) | X | X |
| Comparative Example 3 | Propylene oxide modified monomer | Δ | |
| Comparative Example 4 | Epoxy acrylate based pre polymer | Δ | |
| Comparative Example 5 | Polyester acrylate based pre polymer | X | |
| Comparative Example 6 | Urethane acrylate based pre polymer | Δ | |
| Comparative Example 7 | Polyester based monomer | X | |
| Comparative Example 8 | HPPA monomer | Δ | |
| Comparative Example 9 | Modified alkyl acrylate monomer | X | |

○: preferable,
Δ: slightly preferable,
X: poor
HPPA monomer: 2-hydroxy-3-phenoxy propyl acrylate As shown in Table 1, according to the examples 1 and 2, since the ethylene oxide modified polymerizable compound was respectively contained in the ionizing radiation curing resin of the surface protection layer, the respective oil resistance was preferable and preferable results were obtained for the pollution resistance with respect to the water based pollutant. However, even in the case of an ethylene oxide modified polymerizable compound, if the number of linkage n was too small as n=2 (comparative example 1), or on the contrary, it was too large as n=23 (comparative example 2), the oil resistance of a preferable level could not be obtained. In particular, if the n number was too large, due to too much increase of the hydrophilic property, the pollution resistance was lowered so that the oil resistance and the pollution resistance could not be both provided preferably.

Moreover, according to the comparative examples 3 to 9 with the other polymerizable compounds used instead of the ethylene oxide modified polymerizable compound, the oil resistance of a preferable level could not be obtained respectively. For example, according to the comparative example 3 using a propylene oxide modified polymerizable compound same in terms of the alkylene oxide modified, even though the oil resistance could be improved slightly compared with the conventional configuration, it was resulted in slightly preferable level at most due to the low hydrophilic property degree. According to the comparative examples 4 to 9 using the other polymerizable compounds, the respective oil resistance was poor or slightly preferable level at most so that a preferable performance could not be obtained.

TABLE 2

Performance difference by the composition ratio of the ethylene oxide modified polymerizable compound

| | Composition ratio(Ethylene oxide modified monomer:tetrafunctional acrylate monomer) | Oil resistance | Pollution resistance |
|---|---|---|---|
| Comparative Example 10 | 20:80 | X | ○ |
| Example 3 | 30:70 | ○ | ○ |
| Example 1 | 40:60 | ○ | ○ |
| Example 4 | 50:50 | ○ | ○ |
| Comparative Example 11 | 60:40 | ○ | X |
| Comparative Example 12 | 70:30 | ○ | X |
| Comparative Example 13 | 80:20 | ○ | X |

Moreover, as shown in Table 2, the respective oil resistance was changed also according to the composition ratio of the ethylene oxide modified polymerizable compound, and the preferable results for both of the oil resistance and the pollution resistance were obtained with the composition ratio (mass ratio) of the ethylene oxide modified monomer (trimethylol propane EO modified triacryalte (n=9)): tetrafunctional monomer in a range of 30:70 to 50:50. With the ratio of the ethylene oxide modified polymerizable compound made smaller to the above-mentioned composition ratio of 20:80, the oil resistance became poor. On the contrary, with the ratio of the ethylene oxide modified polymerizable compound made larger to the above-mentioned composition ratio of 60:40, the oil resistance was preferable and the pollution resistance became poor.

TABLE 3

Performance evaluation result

| | Polymerizable compound | Oil resistance | Pollution resistance |
|---|---|---|---|
| Example 5 | Ethylene oxide modified monomer (n = 9) | ○ | ○ |

Moreover, according to the example 5, wherein a colored solid layer was provided in addition to the primer layer in the example 1, as shown in Table 3, a result with the oil resistance and the pollution resistance both provided preferable level was obtained as in the example 1.

EXAMPLE 6

A coated paper 10 as shown in the cross-sectional view of FIG. 2 was produced as follows. After forming a primer layer 4 of a two component curing type urethane resin resulting from a reaction of an acrylic polyol and an isocyanate on a fiber substrate 1 made of a general paper for the building materials of a 30 g/m$^2$ grammage by a 3 g/m$^2$ thickness by gravure printing, an electron beam curing type resin coating solution of the below-mentioned composition, including a trimethylol propane EO (ethylene oxide) modified triacrylate (number of linkage of the ethylene oxide n=9) of an acrylate based trifunctional monomer as the ethylene oxide modified polymerizable compound was formed further thereon by a 4 g/m$^2$ thickness (based on the solid content) with a gravure offset method. Thereafter, by cross linking and curing the coating film by directing an electron beam, and then, curing and cross linking the primer layer, a coated paper 10 having a non colored transparent surface protection layer 2 was obtained. The evaluation results are shown in Table 4 together with the other examples and comparative examples.

Composition of the Electron Beam Curing Type Resin Coating Solution:

| | |
|---|---|
| Trimethylol propane EO modified triacrylate (n = 9) | 25 parts by mass |
| Trimethylol propane triacrylate | 50 parts by mass |
| Ditrimethylol propane tetraacrylate | 5 parts by mass |
| Baked kaolin particles (average particle size 1.5 μm) | 10 parts by mass |
| Mat silica particles (average particle size 5.5 μm) | 8 parts by mass |
| Fine particle silica (average particle size 5 nm) | 0.5 part by mass |
| Silicone methacrylate 1.5 parts by mass | 1.5 parts by mass |

COMPARATIVE EXAMPLE 14

A desired coated paper was produced in the same manner as in the example 6 except that the addition of the baked kaolin particles was omitted for the electron beam curing type resin coating solution used for the formation of the surface protection layer and instead the composition amount of the mat silica particles (average particle size 6 μm) was increased to 18 parts by mass in the example 6.

COMPARATIVE EXAMPLE 15

A desired coated paper was produced in the same manner as in the example 6 except that the electron beam curing type resin coating solution used for the formation of the surface protection layer was changed to one with the ordinary hydrate kaolin particles added instead of the baked kaolin particles in the example 6.

COMPARATIVE EXAMPLE 16

A desired coated paper was produced in the same manner as in the example 6 except that the electron beam curing type resin coating solution used for the formation of the surface protection layer was changed to one with the addition of the baked kaolin particles omitted (the mat silica particles, or the like are included as it is) in the example 6.

COMPARATIVE EXAMPLE 17

A desired coated paper was produced in the same manner as in the example 6 except that the electron beam curing type resin coating solution used for the formation of the surface protection layer was changed to one using an epoxy acrylate based pre polymer instead of the ethylene oxide modified polymerizable compound in the example 6.

Performance Evaluation

The coated papers produced respectively in the examples and the comparative examples were evaluated for the oil resistance and the pollution resistance, and furthermore, for the marring resistance. The oil resistance and the pollution resistance were evaluated in the same manner as in the example 1.

The marring resistance was evaluated by the visual observation of the glossiness change state of the decorative sheet surface after carrying out the rubbing test (steel wool resistance test) of mounting steel wool (product name: "BONSTAR" produced by Nihon Steel Wool Corp.) to a weight for applying a 21 kPa (1.5 kgf/7 cm$^2$) load and rubbing the decorative sheet surface reciprocally for 20 times. Those with slight glossiness change were judged to be preferable (○), and those with the surface glossiness change were judged poor (×).

TABLE 4

| | Performance evaluation result | | |
|---|---|---|---|
| | Oil resistance | Pollution resistance | Marring resistance |
| Example 6 | ○ | ○ | ○: Slight glossiness change |
| Comparative Example 14 | ○ | ○ | X: With the glossiness change |
| Comparative Example 15 | ○ | ○ | X: With the glossiness change |
| Comparative Example 16 | ○ | ○ | X: With the glossiness change |
| Comparative Example 17 | Δ | — | ○: Slight glossiness change |

○: preferable,
Δ: slightly preferable,
X: poor

As shown in Table 4, according to the example 6, since the ethylene oxide modified polymerizable compound was contained and the baked kaolin particles were contained in the ionizing radiation curing resin of the surface protection layer, the oil resistance was preferable. Additionally, the pollution resistance with respect to the water based pollutant was also preferable, and a preferable result was obtained for the marring resistance with the slight surface glossiness change.

However, according to the comparative examples 14 to 17 without the addition of the baked kaolin particle, even though the oil resistance and the pollution resistance were preferable, the marring resistance was poor in any case including the comparative example 15 with the addition of the hydrate kaolin particle. Moreover, according to the comparative example 17 with the baked kaolin particle added but not using the ethylene oxide modified polymerizable compound for the ionizing radiation curing resin, although the marring resistance was preferable, the oil resistance was slightly preferable at most and a preferable level could not be obtained.

EXPLANATION OF REFERENCES

Figure 1A:
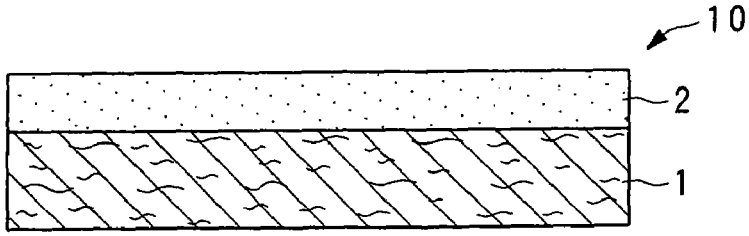
FIGS. 1A to 1C are cross-sectional views showing several form examples of the coated paper of the present invention.
Figure 1B:
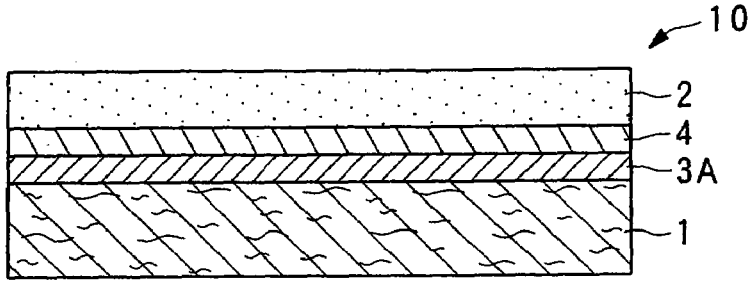
Figure 1C:
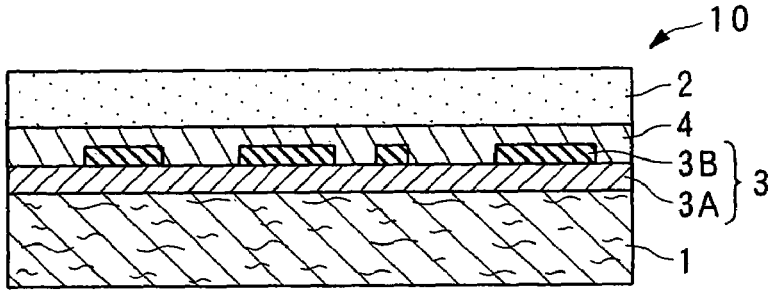
Figure 2:
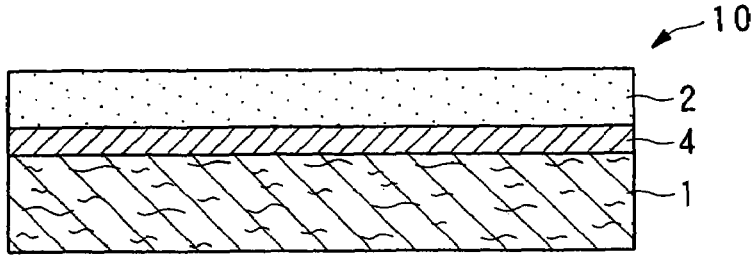
FIG. 2 is a cross-sectional view showing another form example of the coated paper of the present invention.

1 fiber substrate
2 surface protection layer
3 decorative layer
3A solid colored layer
3B graphic pattern layer
4 primer layer
10 coated paper

The invention claimed is:

1. A coated paper comprising at least a surface protection layer of a cross-linking cured material of an ionizing radiation curing resin laminated on a fiber substrate, wherein the ionizing radiation curing resin of the surface protection layer contains an ethylene oxide modified polymerizable compound, and further wherein the surface protection layer contains a baked kaolin particle.

2. The coated paper according to claim 1, wherein the surface protection layer is laminated after successively laminating a solid colored layer and a primer layer on the fiber substrate.

3. The coated paper according to claim 2, wherein the solid colored layer and the primer layer are a cured material of an urethane resin resulting from a reaction of an acrylic polyol and an isocyanate.

4. The coated paper according to claim 1, wherein the ethylene oxide modified polymerizable compound is a trimethylol propane ethylene oxide modified tri(meth) acrylate, or a bisphenol A ethylene oxide modified di(meth) acrylate.

5. The coated paper according to claim 1, wherein a number of linkage "n"(number per one molecule) of an ethylene oxide repeating unit in an ethylene oxide modified portion of the ethylene oxide modified polymerizable compound is 2 to 20.

* * * * *